United States Patent [19]

Rene et al.

[11] Patent Number: 5,010,348

[45] Date of Patent: Apr. 23, 1991

[54] DEVICE FOR EXCITING A WAVEGUIDE WITH CIRCULAR POLARIZATION FROM A PLANE ANTENNA

[75] Inventors: Didier Rene, Toulouse; Thierry Dusseux, Colombes; Philippe Ginestet, Toulouse, all of France

[73] Assignee: Alcatel Espace, Courbevoie, France

[21] Appl. No.: 268,302

[22] Filed: Nov. 7, 1988

[30] Foreign Application Priority Data

Nov. 5, 1987 [FR] France ..... 87 15359

[51] Int. Cl.[5] ..... H01Q 1/38

[52] U.S. Cl. ..... 343/700 MS; 343/778; 343/786; 343/789; 333/21 A; 333/26

[58] Field of Search ..... 343/700 MS, 786, 778, 343/789; 333/21 A, 26

[56] References Cited

U.S. PATENT DOCUMENTS

| | | | |
|---|---|---|---|
| 3,665,480 | 5/1972 | Fassett | 343/700 MS |
| 4,067,016 | 1/1978 | Kaloi | 343/700 MS |
| 4,743,918 | 5/1988 | Rannou et al. | 343/895 |
| 4,761,654 | 8/1988 | Zaghloul | 343/700 MS |

FOREIGN PATENT DOCUMENTS

| | | | |
|---|---|---|---|
| 0059927 | 9/1982 | European Pat. Off. . | |
| 71069 | 2/1983 | European Pat. Off. | 343/700 MS |
| 2462787 | 2/1981 | France . | |
| 160103 | 12/1981 | Japan | 343/700 MS |
| 59605 | 4/1983 | Japan | 343/700 MS |
| 181706 | 10/1984 | Japan | 343/700 MS |
| 207703 | 11/1984 | Japan | 343/700 MS |
| 217702 | 10/1985 | Japan | 343/700 MS |
| 843042 | 6/1981 | U.S.S.R. | 343/700 MS |

OTHER PUBLICATIONS

Yee et al., "An Extremely Lightweight Fuselage-Integrated Phased Array for Airborne Applications", IEEE Trans. on Antennas and Prop., vol.-29, No. 1, Jan. 1981, pp. 178-182.

Patent Abstract of Japan, vol. 10, No. 248, (E-431) (2304), Aug. 26, 1986 (Sumitomo Electric Ind. Ltd.) 21-04-1986.

*Primary Examiner*—Michael C. Wimer

*Attorney, Agent, or Firm*—Sughrue, Mion, Zinn, Macpeak & Seas

[57] ABSTRACT

A device for exciting a waveguide with circular polarization from a plane antenna, said waveguide (10) being a rectilinear hollow waveguide closed at one of its ends (12), said antenna being excited by at least two coaxial ports (13, 14) fed in phase quadrature by a circuit including a hybrid coupler (15), and being constituted by a radiating plane metal pattern (11) disposed on the surface of an insulating substrate (18) closing the waveguide (10) perpendicularly to its axis of symmetry.

7 Claims, 1 Drawing Sheet

DEVICE FOR EXCITING A WAVEGUIDE WITH CIRCULAR POLARIZATION FROM A PLANE ANTENNA

FIELD OF THE INVENTION

The invention relates to a device for exciting a waveguide with circular polarization from a plane antenna, e.g. a printed or plated antenna.

BACKGROUND OF THE INVENTION

This device is a compact device for exciting a waveguide with wideband circular polarization in both directions and with high purity of polarization. It enables a right and/or left circularly polarized wave to be generated in a waveguide having a section which may be square or circular, for example.

Such a device is intended for use in any waveguide radiating element requiring compact excitation in circular polarization from a transverse electromagnetic (TEM) line feed, e.g. a coaxial line, a three-plate line, or a microstrip line.

Prior systems for generating a circularly polarized wave in a waveguide from a TEM line are:

- either systems constituted by a TEM line to waveguide transition together with a polarizer which gives rise to considerable bulk (with a typical length being greater than two wavelengths) for performance equivalent to the performance of a device in accordance with the invention;
- or else compact systems using a resonator at the end of a waveguide, but providing mediocre quality in terms of bandwidth and polarization purity and therefore incompatible with pure circular polarization as used in telecommunications frequency bands.

An article by C. H. Chen, A. Tulintseff, and R. M. Sorbello entitled "Broadband two-layer microstrip antenna" published in IEEE 1984 (A.P.S. 8-1 "Antenna and propagation symposium" 1984) describes a broadband two-layer printed antenna that radiates freely. Such an antenna is characterized by two resonant frequencies. By exciting this antenna with two orthogonal modes at equal amplitude and quadrature phase, circular polarization operation is obtained.

In contrast, the object of the invention is to generate a right and/or left circularly polarized wave in a waveguide.

SUMMARY OF THE INVENTION

To this end, the present invention proposes a device for exciting a waveguide with circular polarization from a plane antenna, said waveguide being a rectilinear hollow waveguide closed at one of its ends, said antenna being excited by at least two coaxial ports fed in phase quadrature by a circuit including a hybrid coupler, the device being characterized in that said antenna is constituted by a radiating plane metal pattern disposed on the surface of an insulating substrate closing the waveguide perpendicularly to its axis of symmetry.

Such a device provides excellent matching over a broad frequency band and excellent circular polarization purity over said band.

In a particular embodiment, the waveguide has an axis of symmetry, with the coaxial ports being situated in pairs at 90° to one another about said axis of symmetry. The antenna includes at least one metal disk disposed on the surface of a plane substrate and symmetically about the axis of symmetry of the guide.

Such a device serves to mitigate the drawbacks of prior art systems. It makes it possible:

- to reduce bulk; and
- to increase the frequency band width for given values of matching and ellipticity.

The device of the invention has the following characteristics:

- it is extremely compact, circular polarization is directed generated in this case from a TEM line over a length which is shorter than one wavelength;
- it is provided with longitudinal rear accesses, thereby enabling these accesses to be coupled without additional coaxial cables to a TEM power distributor for transmission and/or reception parallel to the section of the waveguide, at which location hybrid quadrature-imparting couplers may also be implanted; and
- it can be used with any circular polarization antenna where there is a problem of compactness or bulk for the polarization device.

BRIEF DESCRIPTION OF THE DRAWINGS

The characteristics and advantages of the invention also appear from the following description given by way of non-limiting example and with reference to the accompanying figures, in which.

DESCRIPTION OF THE PREFERRED EMBODIMENTS

Figure 1:
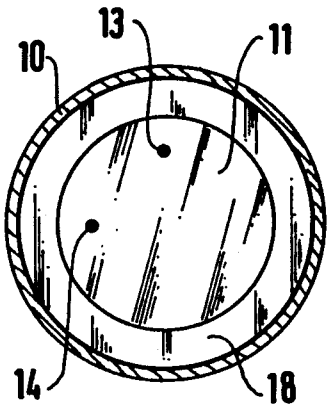

The device of the invention as shown in FIG. 1 is constituted by a waveguide 10, e.g. a cylindrical waveguide, which is excited with circular polarization by an antenna 11, having a single resonator and formed by plating or printing, for example. This antenna thus comprises a plane metal pattern deposited on an insulating substrate. The shape of the antenna varies depending on the performance to be achieved (typically it is square or circular depending on the shape of the waveguide). The end 12 of the waveguide serves as a ground plane for the antenna which is in the form of a disk in this case. The antenna is fed by two matched coaxial ports 13 and 14 situated at 90° relative to each other about the center of the waveguide, with said two ports being isolated from each other by means of a dielectric 18.

Each coaxial port is fed in phase quadrature by a 90° bybrid coupler 15 which may be a branching hybrid coupler, for example. An access 16 of said hybrid coupler 15 generates right circular polarization; its other access 17 generates left circular polarization. The hybrid coupler 15 is unbalanced in amplitude so as to compensate for the coupling between probes and so as to generate a field in each polarization having a minimum ellipticity ratio.

Figure 3:
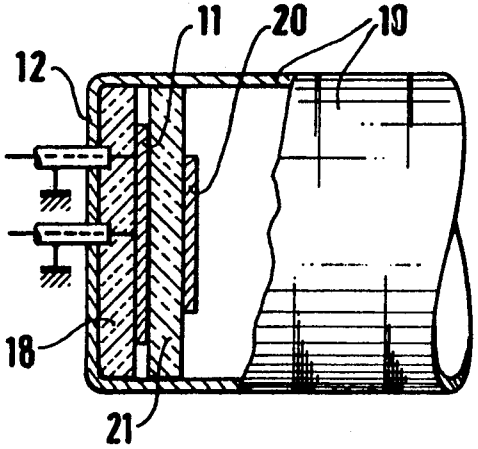
FIG. 3 is a longitudinal section view through a first variant of the device in accordance with the invention.

In a first variant embodiment, as shown in FIG. 3, the antenna which may be plated or printed, is constituted by two resonators 11 and 20, thereby increasing the bandwidth of the device. The two portions 11 and 20 of this two-resonator assembly are, by way of example, in the form of two concentric metal disks and they are spaced apart by means of a dielectric 21.

Figure 5:
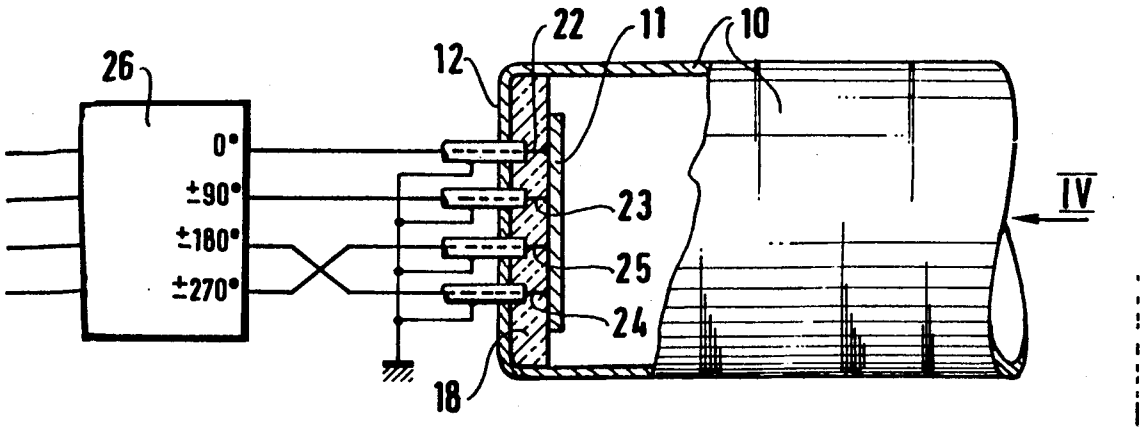
FIGS. 4 and 5 are respectively a front view looking along arrow IV in FIG. 5 and a longitudinal section view through a second variant of the device in accordance with the invention.
Figure 4:
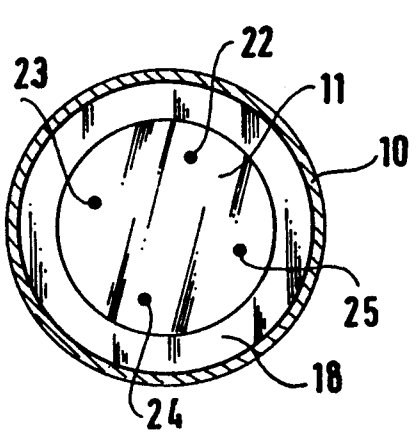

In a second variant embodiment, as shown in FIGS. 4 and 5, the antenna 11 (having two resonators or one resonator) and plated or printed, for example, if fed from four coaxial ports 22, 23, 24, and 25 which are fed in quadrature (0°, ±90°, ±180°, ±270°) by a device 26 comprising a hybrid coupler and two matched Ts. Each hybrid coupler and each "rat-race" or each T is balanced (3 dB coupler) and thus generates pure circular polarization waves in the waveguide.

The hybrid coupler produces the phase quadrature required for circular polarization. The "rat-races" or Ts constituting a device for providing symmetry, may alternatively be replaced by other types of "balun" or balancing systems.

The device of the invention as shown in FIG. 3 may be used with the following dimensions (where mm = millimeters):

| | |
|---|---|
| distance between each of the coaxial ports 13 and 14 and the center of the circular resonator 11: | about 20.5 mm; |
| thickness of the dielectric 18: | about 3 mm; |
| thickness of the resonator 11: | about 0.5 mm; |
| thickness of the dielectric 21: | about 7 mm; |
| thickness of the resonator 20: | about 0.5 mm; |
| diameter of the circular resonator 11: | about 41 mm; |
| diameter of the circular resonator 20: | about 28 mm; |
| diameter of the cylindrical waveguide 10: | about 52 mm. |

The following performance can then be obtained:
frequency band: 15% (e.g. 3700 MHz to 4200 MHz);
matching: SWR in this band < 1.20; and
ellipticity < 0.6 dB.

Naturally the present invention has been described and shown merely by way of preferred example and its component parts could be replaced by equivalent parts without thereby going beyond the scope of the invention.

Figure 2:
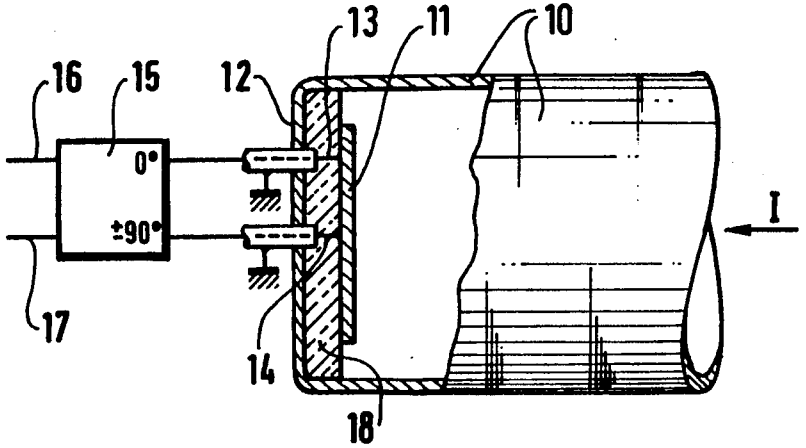
FIGS. 1 and 2 are respectively a front view as seen in the direction of arrow I in FIG. 2, and a longitudinal section view through a device in accordance with the invention.

Thus, the device of the invention may comprise one resonator (FIGS. 1, 2), two resonators (FIG. 3), or some large number of resonators: three, four, . . .

These resonators are not necessarily circular in shape; they may be of any shape: circular, square, cross-shaped, star-shaped, hexagonal, and they may include asymmetrical features or notches. They may also include holes (non-metallized areas) of arbitrary shape within their outlines.

Thus, the dielectric layers (18, 21) supporting these resonators (11, 20) may be replaced in part or completely by other types of support (spacers, standoffs) of any type of material (conducting or insulating) known to the person skilled in the art.

Thus, the resonators may be extended out from their places or within their planes by metal pieces which may optically come into electrical contact with the wall of the waveguide.

Thus, the waveguides used may be circular or square in shape and also hexagonal, polygonal, elliptical, or other. They may have features such as excess thickness or grooves in the longitudinal, oblique, or transverse directions, or they may have local features such as pegs, irises, or slots. They may also be flared or narrowed locally or globally, or one after the other, e.g. in accordance with some predetermined law.

Thus, the excitation system may equally well be situated inside the waveguide.

Thus, the device of the invention may be fed by 2, by 4, or by some larger number of accesses, which may be connected to the first resonator (11) but also to the other resonators (20, . . .).

What is claimed is:

1. A device for exciting a rectinlinear hollow waveguide having an axis of symmetry and being closed at a first end perpendicular to said axis of symmetry; said device comprising: a plane antenna comprising a ground plane constituted by said first end of the waveguide; at least two dielectric layers, separated by a first metallic surface, and disposed on the interior surface of said waveguide first end; the dielectric layer of said layers remote from said waveguide first end having a second metallic surface disposed thereon, said dielectric layers and said metallic surfaces all being disposed symmetrically with respect to the axis of symmetry of the waveguide, and wherein said metallic surfaces each form a radiating element and constitute a plurality of superposed resonators disposed on the interior surface of said waveguide first end, at least one pair of coaxial lines connected to said first metallic surface, circumferentially spaced from each other by 90° relative to the axis of symmetry of the waveguide and a circuit including a hybrid coupler feeding said coaxial line in quadrature for exciting the waveguide with circular polarization.

2. A device according to claim 1, wherein each said radiating element is a printed circuit metallic pattern disposed on a respective dielectric layer.

3. A device according to claim 1, characterized in that each said radiating element is a metal plating disposed on a respective dielectric layer.

4. A device according to claim 1, wherein said at least one pair of coaxial lines comprise coaxial ports in plural pairs at circumferentially spaced 90° intervals from each other relative to the axis of symmetry of the waveguide and connected to said first metallic surface.

5. A device according to claim 4, wherein said metallic surfaces are constituted by metal disks disposed respectively on the surfaces of said at least two dielectric layers and constituting said radiating elements.

6. A device according to claim 5, characterized in that the waveguide is a circular waveguide.

7. A device according to claim 5, wherein said rectilinear hollow waveguide is of metal, said dielectric layers comprise a first dielectric layer interposed between said closed first end of said rectilinear hollow waveguide and a first metal disk, and a second dielectric layer is interposed between the surface of the first metal disk remote from said first dielectric layer and a second metal disk positioned on the side of said second dielectric layer remote from said first metal disk, and wherein said first metal disk constitutes said first radiating element and said second metal disk constitutes said second radiating element.

* * * * *